United States Patent [19]

Wagenseil

[11] Patent Number: 4,765,228

[45] Date of Patent: Aug. 23, 1988

[54] AXIAL PISTON MACHINE WITH A DEVICE FOR FLUSHING THE CIRCUIT

[75] Inventor: Ludwig Wagenseil, Vohringen, Fed. Rep. of Germany

[73] Assignee: Hydromatik GmbH, Elchingen, Fed. Rep. of Germany

[21] Appl. No.: 73,987

[22] Filed: Jul. 16, 1987

[30] Foreign Application Priority Data

Jul. 31, 1986 [DE] Fed. Rep. of Germany ..... 3625941
Nov. 14, 1986 [DE] Fed. Rep. of Germany ..... 3638890

[51] Int. Cl.[4] ..... F01B 13/04
[52] U.S. Cl. ..... 91/486; 91/499
[58] Field of Search ..... 91/484–487, 91/499; 92/57

[56] References Cited

U.S. PATENT DOCUMENTS

| | | | |
|---|---|---|---|
| 2,168,658 | 8/1939 | Thomas | 91/485 |
| 3,604,314 | 9/1971 | Steiner | 91/485 |
| 3,738,228 | 6/1973 | Harrison | 91/486 X |
| 4,382,399 | 5/1983 | Lotter | 91/486 |
| 4,576,554 | 3/1986 | Wagenseil et al. | 417/270 |
| 4,579,043 | 4/1986 | Nikolaus et al. | 91/499 |

FOREIGN PATENT DOCUMENTS

| | | | |
|---|---|---|---|
| 675917 | 12/1963 | Canada | 91/499 |
| 1946658 | 6/1970 | Fed. Rep. of Germany | 91/486 |
| 2247437 | 8/1976 | Fed. Rep. of Germany | 417/217 |
| 1064041 | 12/1983 | U.S.S.R. | 91/486 |

*Primary Examiner*—Carlton R. Croyle
*Assistant Examiner*—Paul F. Neils
*Attorney, Agent, or Firm*—Scully, Scott, Murphy & Presser

[57] ABSTRACT

With the object of improving the flushing arrangement in an axial piston machine for use in a closed-circuit hydrostatic drive, having a control member (18) that controls the working cycle of the axial piston machine (1) and having a circuit flushing arrangement (31) that includes a flushing valve (33) that is arranged in the control member (18), can be acted on by high pressure and connects the low pressure line (37 or 38) with a return line (44), the valve body of the flushing valve (33) comprises a cylindrical sleeve valve (34) displaceably mounted in a guide bore (35) directly between the high pressure duct (38) and the low pressure duct (37) in the control member (18), the guide bore being connected with the free space (23) of the housing (2) of the axial piston machine in the region of the sleeve valve (34) by a connecting duct (44).

22 Claims, 3 Drawing Sheets

AXIAL PISTON MACHINE WITH A DEVICE FOR FLUSHING THE CIRCUIT

TECHNICAL FIELD OF THE INVENTION

The invention relates to an axial piston machine which is employed in a closed-circuit hydrostatic drive, including a control member for controlling the working cycle of the axial poston machine and with a circuit flushing device incorporating a flushing valve which is arranged in the control member. The machine can be acted upon by high pressure and connects a low pressure line of the drive with a respective return line thereof.

BACKGROUND OF THE INVENTION

An axial piston machine of this kind is described and illustrated in DE-OS-No. 19 46 658.

It is known to provide closed circuit hydrostatic drives with a device for flushing and optionally also feeding the circuit, for the purpose of continuously taking off hot pressure medium and exchanging it for cooled medium and thus supplying fresh pressure medium to replace losses of pressure medium.

In the hydrostatic drive described and illustrated in DE-OS-No. 19 46 658 the two hydrostatic machines are provided with a common control member, so that this hydrostatic drive forms a compact component, and the flushing valve of the flushing device is arranged in the common control member. There are two high-pressure and two low-pressure ducts extending between the hydrostatic machines, the circuit feeding device being likewise integrated into the control member as a feed/supply line connected with one of the two pairs of high-pressure and low-pressure lines via non-return valves.

In the known arrangement the flushing valve comprises two spring-loaded non-return valves arranged in the bridge part of a U-shaped passage arrangement that connects the other pair of high-pressure/low-pressure lines with a common flushing duct.

In the known arrangement, as well as the flushing valve being itself expensive, since it includes two spring-loaded non-return valves, the layout of the system of lines in which the non-return valves are situated is complicated, since no less than four duct sections must be provided in the control member to form the system of lines needed for the flushing, and in addition two of the non-return valves must be provided with return springs. The result is an expensive construction in which, bearing in mind that the four duct sections have to be accommodated in the control member, the relatively small size of the control member results in a complicated system of lines that weakens the control member. Moreover, the duct sections extending between the non-return valves and the low-pressure or high-pressure duct, as the case may be, must be drilled from outside.

OBJECT OF THE INVENTION

The object of the invention is to simplify the flushing device.

SUMMARY OF THE INVENTION

In the arrangement according to the invention both the flushing duct in the control member and the flushing valve are considerably simplified, so that the cost and effort involved in production and assembly are reduced. Instead of four flushing duct sections in the known arrangement, only two flushing duct sections are needed in the arrangement according to the invention: the control member is thus much less weakened. In addition a control valve can be used that can be made in one piece and likewise represents a considerable simplification. A further advantage of the arrangement according to the invention is that the flushing medium is taken off directly into the free space of the housing, so that no additional lines are needed outside the housing.

In the arrangement according to the invention the device for feeding the circuit is not arranged in the region of the control member. Hence the arrangement according to the invention can very advantageously be integrated with a feed device as described and illustrated in German Pat. No. 2 247 437.

Further features according to the invention likewise contribute to the simplification of the axial piston machine.

According to the invention the flushing device simultaneously functions to lubricate the bearing of the intermediate guide pin and/or the support of the control device shaft. The flushing medium reaches the free space of the housing via the respective bearing and is returned to the pressure medium tank by the drainage line, which is needed in any event.

The arrangements according to various features of the invention relate to a middle-centered sleeve valve, whereby the functioning is again improved with a simple arrangement.

By the arrangement according to as set forth hereinbefore a minimum low pressure or a minimum feed pressure can be maintained, which is particularly important on starting up the axial piston machine. These features also contribute to the further simplification of the axial piston machine.

The arrangements in as set forth hereinbefore independent inventive importance, since the advantages that can be obtained through them are independent of whether the axial piston machine is arranged for delivery in two directions or for engine and pump operation.

BRIEF DESCRIPTION OF THE DRAWINGS

The invention will now be explained in more detail with reference to exemplary embodiments shown in simplified drawings, in which.

DETAILED DESCRIPTION OF PREFERRED EMBODIMENTS OF THE INVENTION

Figure 1:
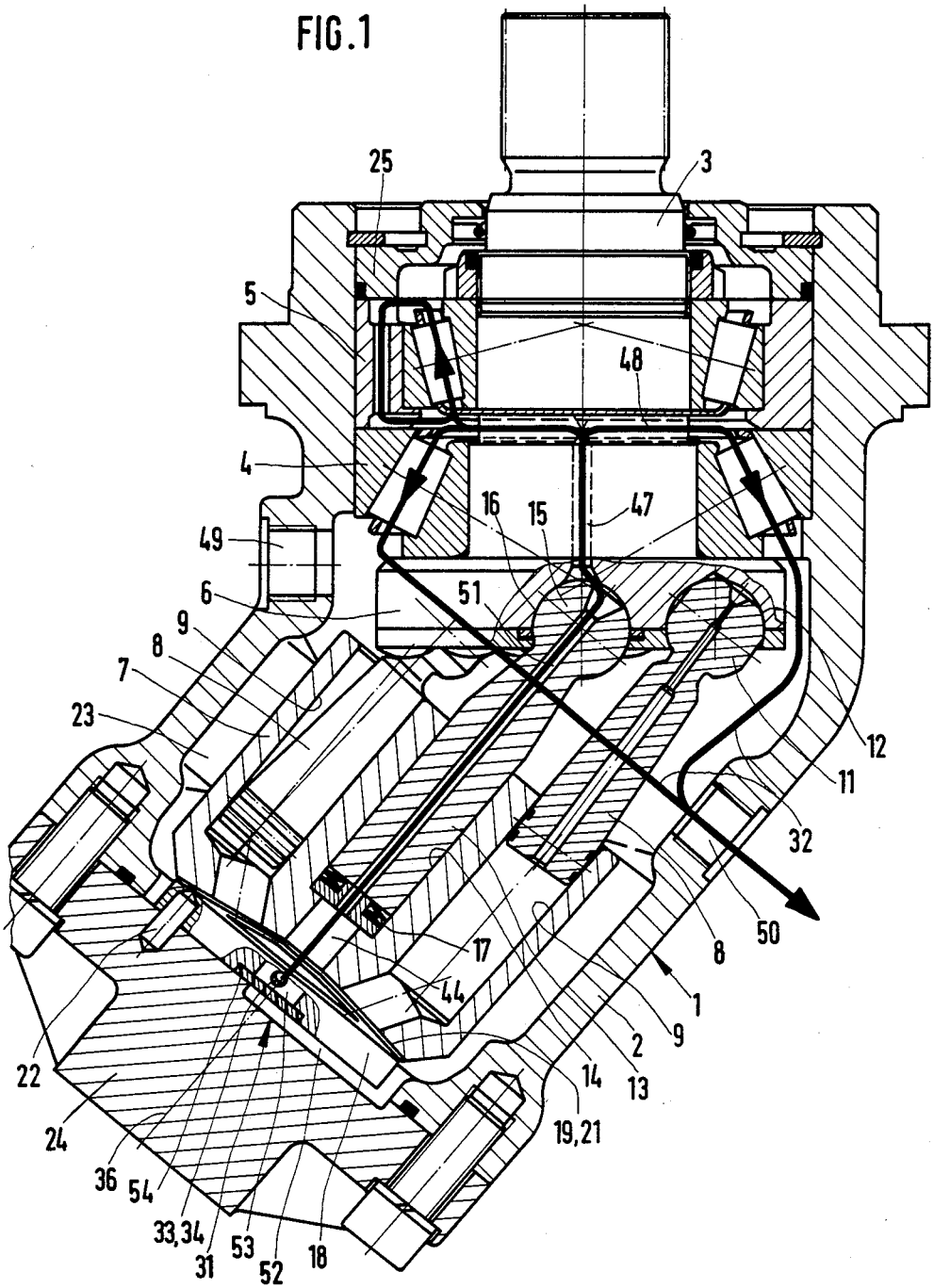
FIG. 1 is an axial section through an axial piston machine according to the invention.

The axial piston machine indicated generally by 1 in FIG. 1 is a machine of the oblique axial type, with a housing 2 in which are mounted a drive shaft 3 in roller bearings 4, 5 and a cylinder block 7 driven by the driving flange 6 of the drive shaft 3. In the cylinder block 7 a plurality of spherical pistons 8, arranged on an arc of a circle, are displaceably mounted in piston bores 9 and have ball-shaped piston heads 11 mounted in spherical bearings 12 in the drive flange 6. Mounted centrally in a guide bore in the cylinder block 7 is a guide pin 13 which also has a spherical head 15 by which it is mounted in a central spherical bearing 16 in the drive flange. A compression spring 17 is arranged in the guide bore 14, between the guide pin 13 and the cylinder block 7 for the purpose of elastically pretensioning the cylinder block 7 towards the side away from the drive flange 6 against a control plate 18 on which the cylinder block is mounted. For this purpose the control plate 18 has, on its side facing the cylinder block 7, a spherically convex sliding bearing surface 19 against which a spherically concave sliding bearing surface 21 of the control plate 18 is fixed by centering pins 22 to a cover 24 that tightly closes the free space 23 of the housing 2. At its other end face the housing 2 is closed and sealed by a flange 25.

Figure 3:
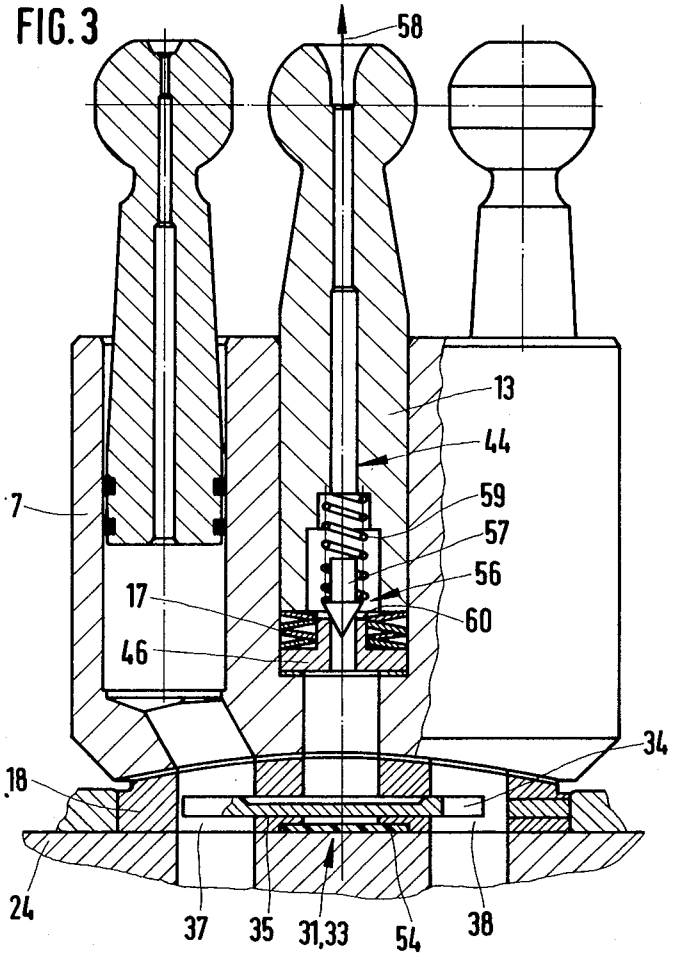
FIG. 3 is a view corresponding to that in FIG. 2 of a second exemplary embodiment of the axial piston machine.
Figure 2:
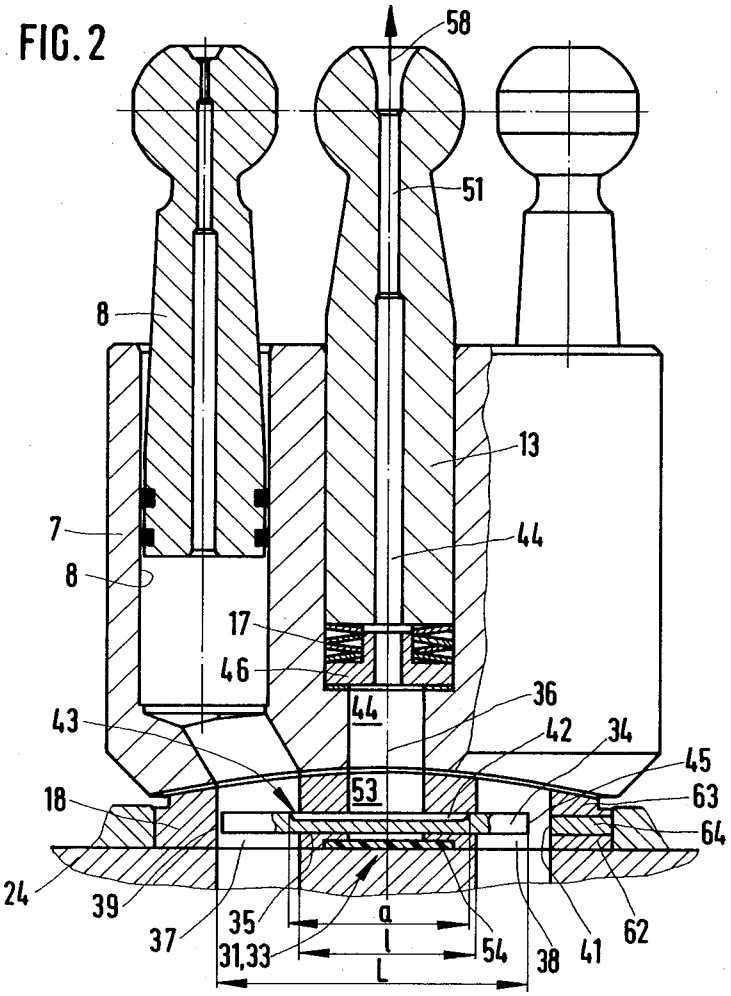
FIG. 2 is a somewhat enlarged detailed view of the cylinder block and control plate of the axial piston machine, turned through 90°.

The axial piston machine 1 is connected to a device, shown only in FIGS. 2 and 3 and indicated generally by 31, for flushing the circuit, the route of the scaveng oil being shown in FIG. 1 by an arrow 32.

The flushing device 31 comprises a flushing valve 33 integrated in the control plate 18, made up of a valve needle 34 displaceably mounted in a guide bore 35 in the control plate 18 that extends diametrically, i.e. intersecting the axis 36, between the working ducts, i.e. the control kidneys 37, 38 that respectively form high-pressure (HP) and low-pressure (LP) ducts, depending on the operation of the machine. The valve needle 34 is longer than the distance between the control kidneys 37, 38. The displacement of the valve needle 34 is limited by the stops 39, 41 formed by the outer walls of the control kidneys 37, 38. The length L of the valve needle 34 is chosen so that in the stop position the end of the valve needle 34 facing away from the respective stop 39, 41 projects into the control kidney 37, 38 concerned. The duct through the flushing valve 33 is formed by a longitudinal groove 42 in the valve needle 34, the length a of which corresponds approximately to the distance l between the control kidneys 37, 38. The longitudinal groove 42 is arranged so that when the valve needle 34 is up against the left-hand stop 39 (as shown in FIGS. 2 and 3) the left-hand end of the longitudinal groove 42 projects into the control kidney 37 so as to form an opening 43. The flow diameter of the duct can be determined by this opening 43 or by the cross-section of the groove 42 in the manner of a throttle. In this position the righthand end of the groove 42 is closed by the wall of the guide bore 35, so that there is only a duct between the control kidney 37 and a connecting duct 44 arranged centrally in the control plate 18. When the valve needle 34 is up against the right-hand stop 41 the right-hand end of the groove 42 projects into the control kidney 38 to form an opening, while the lefthand end of the groove 42 is closed by the wall of the guide bore 35.

The flushing valve 33 is controlled automatically by the high pressure acting on one of the end faces 45 of the valve needle 34 and displacing this against the respective stop 39 or 41. In the position shown the valve needle 34 is displaced to the left by the high pressure in the control kidney 38 against the stop 39. In the switching position of the flushing valve 33 or of the valve needle 34 the control kidney with the low pressure, and thus the LP line, is connected with the connecting duct 44. As shown in FIGS. 2 and 3, this is continued in the cylinder block 7 in a spring-receiving member 46 and in the guide pin 13, so that the flushing oil coming from the respective LP line reaches the bearing 16 (FIG. 1) to lubricate it. From this point on the connecting duct 44 continues in the drive shaft 3 first as an axial bore 47 and then as a diametrical bore 48, the latter ending between the two roller bearings 4, 5. The flushing oil thus passes from the bearing 16 to the roller bearings 4, 5, flowing along the line indicated by the arrow 32 in FIG. 1, and arrives in the free space 23 of the housing 2. From there an oil drain line (not shown) leads out from one of the connections 49, 50 to the oil supply container. So that the spherical head 15 can perform rocking movements in the bearing 16 while keeping the connecting line 44 open, the facing ends of the axial bore 47 and the duct section 51 in the head 15 are widened to a trumpet shape.

Alternatively a second connecting duct 52 shown in FIG. 1 can be provided between the flushing valve 33 and the free space 23 of the housing, which likewise leads from the axial part of the duct 53 into the control plate 18, but first runs radially beneath the control plate 18 and then axially in the housing cover 24. This arrangement allows one and the same control plate 18 to be used for constructions in which take-off of the flushing oil through the cylinder block 7 is not desired or is not possible. In the present exemplary embodiment the connecting duct 52 is closed by a sealing plate 54 that is inserted in a recess on the underside of the control plate 18.

In the embodiment shown in FIG. 3 a pressure valve 56 opening in the direction of flow of the flushing oil is provided in the connecting duct 44 for the purpose of maintaining a minimum low pressure or minimum feed pressure. The pressure valve 56 consists of a conical valve body 57 that is preloaded by a compression spring against the direction of flow of the flushing oil, indicated by 58, against a valve seat 60 formed by a spring receiving member 46. The pressure valve 56 is thus arranged in the cylinder block 7 or in the guide pin 13, or is connected to these parts.

The valve needle 34 can be inserted or removed through an access opening 62 arranged in a part of the rim 63 on the outer side of the control kidney 38 in line with the guide bore 35. The access opening 62 is closed by a stopper 64 that forms the stop 41.

The travel of the valve needle 34 under the influence of the high pressure depends on its length L and on the distance apart of the stops 39, 41. In the embodiment shown in FIG. 4 the stops 39, 41 are inside the control kidneys 37, 38. In this embodiment the stops 39, 34 are formed by extensions 65 of two stoppers 64 that project into the control kidneys 37, 38, the stoppers 64 being arranged in the region of the rim part 63 of a through access hole 62 and being fixed there.

Figure 4:
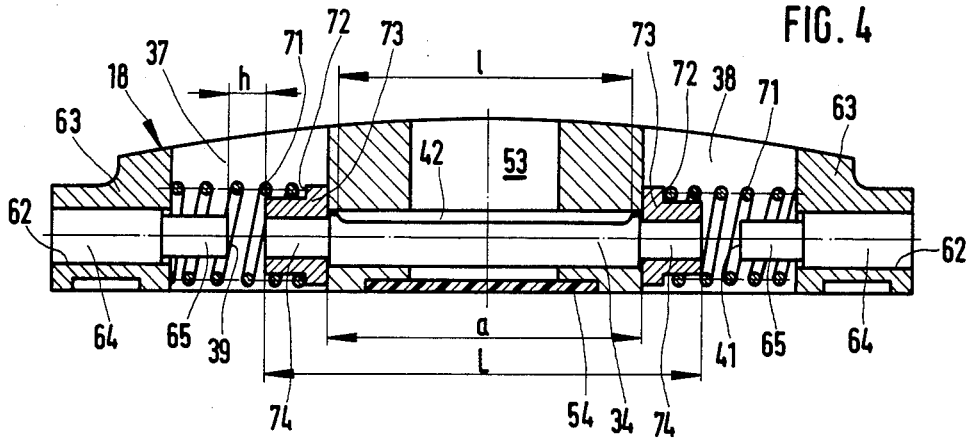
FIG. 4 shows a control plate, in axial section, as a further exemplary embodiment.

The path of displacement of the valve needle 34 depends on its length L and on the distance between the outer walls of the control kidneys 37, 38. As shown in FIG. 4 the valve needle 34 is made shorter by about the lengths of the extensions 65 or stops 39, 41 projecting into the free space of the control kidneys 37, 38, but in this embodiment it likewise projects on both sides into the free space of the control kidneys 37, 38. The cross-section of the extensions 65 is preferably reduced in order to reduce the flow resistance that they cause. Preferably the extensions 65 are tapered cylindrical sections.

Figure 5:
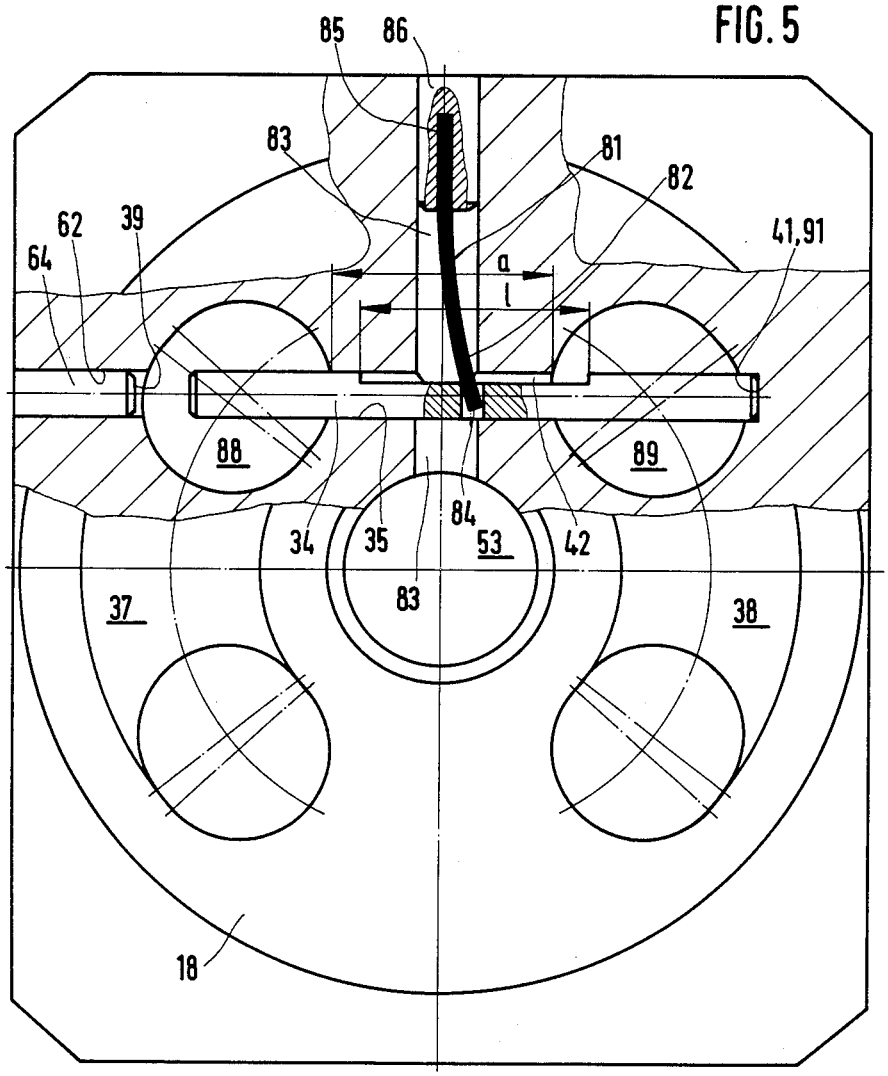
FIG. 5 shows a control plate in radial section as a further exemplary embodiment.

In the embodiments shown in FIGS. 4 and 5 the valve needle 34 is centered by spring tension. According to FIG. 4 this is done by two compression springs 71 arranged one on each side of the valve needle 34 which can be supported on the outer walls of the control kidneys 37, 38 or on the shoulders of the stoppers 64, with their inner ends acting against shoulders 72 on the valve needle 34. The shoulders 72 can be arranged on the valve needle 34 itself, but in the present embodiment the shoulders 72 are arranged on flange pieces 73 fastened in the region of the ends of the valve needle 34 or slipped over the tapered sections 74 of the valve needle 34. The spacing of the shoulders 75, i.e. the distance between the flange pieces 73, corresponds to the distance a between the inside walls of the control kidneys 37, 38. The valve needle 34 is thus held relatively stably in its centered position. The valve needle 34 is displaced to the left or right by the respective high pressure, so that one end of the longitudinal groove 42 projects into the respective control kidney 37, 38, whereby the duct to the connecting duct section 53 is opened. In the unpressurised state the valve needle 34 is again in its centred position. The distance travelled by the valve needle 34 out of this position is indicated by h.

In the embodiment shown in FIG. 5 a substantially straight leaf spring 81 that extends transverse to the valve needle 34 with its free end engaging in a hole in the valve needle 34 is used to center the valve needle 34. The leaf spring 81 is arranged in a passage 83 that extends transverse to and preferably centrally of the guide bore 35 or the valve needle 34, and has a large enough cross-section for the spring 81 to perform the deflection necessary for the required travel of the needle 34. The passage 83 preferably extends radially of the control plate 18 and is drilled into it from the outside. If the passage 83 extends beyond the guide bore 35 into the duct section 53, a connection is automatically made to the control kidneys 37, 38.

The cross-section of the passage 83 is preferably larger than the guide bore 35 so that there is a duct around the valve needle 34. This duct can however be formed by a through hole 84 in which the free end 82 of the bending spring engages. A simple way of mounting the bending spring 81 results if its fixing end 85 is received and mounted in an axial hole in a stopper 86 for the passage 83. In the position shown in FIG. 5 the duct through from the control kidney 38 to the connecting duct section 53 is open. That is to say, the pressure in the control kidney 37 is high. When the axial piston machine 1 stops the leaf spring 81 returns the valve needle 34 to its centre position in which—was the case in all the embodiments described above—the longitudinal groove 42 is closed, since its length l is shorter than the distance between the inside walls of the control kidneys 37, 38. In the present embodiment axial duct sections 88, 89 are connected to the control kidneys 37, 38 in the region of their ends, in which region the guide bore 35 or the valve needle 34 is arranged.

To provide a flat abutment surface in the embodiment shown in FIG. 5 blind holes 91 are sunk into the outer wall of the control kidney 38 or the duct section 89 on the opposite side to the access opening 64.

I claim:

1. An axial piston machine having a cylinder block with a plurality of cylinders therein; pistons in said cylinders, and drive means for actuating said pistons for use in a closed-circuit hydrostatic drive, having a control member with high and low pressure kidney ducts therein that controls the working cycle of the axial piston machine and having a circuit flushing device that includes a flushing valve that is arranged in the control member, is acted on by high pressure and connects the low pressure line with a respective return line, characterized in that the flushing valve has a valve body which comprises a cylindrical sleeve valve displaceably mounted in a guide bore extending diametrically directly between the high pressure kidney duct and the low pressure kidney duct in the control member, the guide bore being connected with the free space of the housing of the axial piston machine in the region of the sleeve valve by a connecting duct leading to bearings of said machine.

2. An axial piston machine according to claim 1, characterised in that the walls of the high-pressure and low-pressure ducts opposite to the guide bore, or blind holes in the walls, form stops for the sleeve valve.

3. An axial piston machine according to claim 1, characterised in that at least in one or in both of the rim sections of the control member lying opposite to the guide bore there is a coaxial access bore in which a stop or stopper member is arranged.

4. An axial piston machine according to claim 1, characterised in that the guide bore substantially intersects an axis in line with the axis of the control member.

5. An axial piston machine according to claim 1, characterised in that the high-pressure and low-pressure ducts are opposed, arcuately bent or kidney-shaped ducts and the sleeve valve - viewed axially to the piston machine - is arranged in the end region of the ducts or in the region of the kidney-shaped ducts where these are at their shortest distance (a) apart.

6. An axial piston machine according to claim 1, characterised in that the sleeve valve has at least one duct running lengthways that is radially open at the end sides and that in each working position of the sleeve valve the open end of the duct adjacent to the high pressure duct is closed by the wall of the guide bore.

7. An axial piston machine according to claim 6, characterised in that the duct comprises at least one longitudinal groove in the circumferential surface of the sleeve valve.

8. An axial piston machine according to claim 1, characterised in that the connecting duct extends in the control member axially to the side facing away from the cylinder block and then runs through a housing cover holding the control member.

9. An axial piston machine according to claim 8, characterised in that the part of the connecting duct in the control member is a through duct of which the opening facing away from the cylinder block can be closed by a plate that is inserted in a recess.

10. An axial piston machine according to claim 1, characterised in that the connecting duct runs axially in the control member towards, and passes through, the cylinder block.

11. An axial piston machine according to claim 10, characterised in that, to guide the cylinder block, a central guide pin is mounted in a bearing in a driving flange and the connecting duct extends along and through the guide pin into the bearing thereof.

12. An axial piston machine according to claim 11, characterised in that the driving flange forms part of a drive shaft mounted in the housing and the connecting duct is prolonged through a duct running first axially and then radially in the drive shaft in the region of the bearing.

13. An axial piston machine according to claim 1, characterised in that a pressure valve opening in the direction of flow of the flushing medium is arranged in the connecting duct.

14. An axial piston machine according to claim 13, characterised in that said pressure valve is arranged in the cylinder block.

15. An axial piston machine according to claim 14, characterised in that said pressure valve is arranged in a guide pin of the cylinder block.

16. An axial piston machine according to claim 1, characterised in that the sleeve valve is centered by means of at least one spring.

17. An axial piston machine according to claim 16, characterised in that a spring that acts on a shoulder on the sleeve valve is arranged on each side of the sleeve valve.

18. An axial piston machine according to claim 17, characterised in that the springs act on flange pieces arranged on tapered end lugs of the sleeve valve.

19. An axial piston machine according to claim 16, characterised in that the spring comprises a leaf spring transverse to the sleeve valve that engages in a recess in the sleeve valve.

20. An axial piston machine according to claim 19, characterised in that the leaf spring is arranged in a duct that centrally crosses the guide bore.

21. An axial piston machine according to claim 20, characterised in that the fixed end of the leaf spring is fixed in a bore in a stopper for said cross duct.

22. An axial piston machine according to claim 20, characterised in that the said cross duct is arranged in the plane of the control member and is prolonged beyond the guide bore into the connecting duct.

* * * * *